US011081060B2

(12) United States Patent
Park

(10) Patent No.: US 11,081,060 B2
(45) Date of Patent: Aug. 3, 2021

(54) DISPLAY DEVICE AND METHOD FOR DRIVING THE SAME

(71) Applicant: Samsung Display, Co., Ltd., Yongin-si (KR)

(72) Inventor: Jong Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/599,372

(22) Filed: Oct. 11, 2019

(65) Prior Publication Data

US 2020/0193910 A1 Jun. 18, 2020

(30) Foreign Application Priority Data

Dec. 12, 2018 (KR) ..... 10-2018-0160332

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2310/027* (2013.01)

(58) Field of Classification Search
None
See application file for complete search history.

(56) References Cited

U.S. PATENT DOCUMENTS 7,675,492 B2 3/2010 Park et al.
8,330,684 B2 12/2012 Park et al.
2009/0121978 A1* 5/2009 Yang ..... G09G 3/296 345/60
2014/0071112 A1* 3/2014 Han ..... G06F 3/038 345/212
2014/0152717 A1* 6/2014 Seong ..... G09G 3/3225 345/691
2015/0243210 A1* 8/2015 Park ..... G09G 3/2022 345/691
2015/0310827 A1* 10/2015 Song ..... G09G 3/2022 345/690
2016/0210900 A1* 7/2016 Kim ..... G09G 3/3233
2016/0275842 A1* 9/2016 Seok ..... G09G 3/3233
2016/0293101 A1* 10/2016 Jeong ..... G09G 3/3258
2017/0061865 A1* 3/2017 Park ..... G09G 3/325
2017/0061878 A1* 3/2017 Park ..... G09G 3/3233
2017/0124958 A1* 5/2017 Pyo ..... G09G 3/3291
2018/0018922 A1 1/2018 Lee et al.
2020/0064613 A1* 2/2020 Hadley ..... G02B 21/0032

FOREIGN PATENT DOCUMENTS

KR 10-0857672 9/2008
KR 10-2016-0089932 7/2016
KR 10-2018-0007623 7/2019

* cited by examiner

*Primary Examiner* — David D Davis
(74) *Attorney, Agent, or Firm* — H.C. Park & Associates, PLC

(57) ABSTRACT

A display device includes: a display panel including a plurality of pixels each coupled to a scan line and a data line; a scan driver for supplying a scan signal having at least one scan pulse to the scan line; and a pulse controller for adjusting a number of the scan pulses supplied during one frame, based on an image variation between a previous frame and a current frame.

18 Claims, 10 Drawing Sheets

DISPLAY DEVICE AND METHOD FOR DRIVING THE SAME

CROSS-REFERENCE TO RELATED APPLICATION

This application claims priority from and the benefit of Korean Patent Application No. 10-2018-0160332 filed on Dec. 12, 2018, which is hereby incorporated by reference for all purposes as if fully set forth herein.

BACKGROUND

Field

Exemplary implementations of the invention relate generally to an electronic device, and more specifically, to a display device having improved quality.

Discussion of the Background

Among display devices, an organic light emitting display device displays an image using an organic light emitting diode that generates light by recombination of electrons and holes. The organic light emitting display device has a high response speed and is driven with low power consumption.

A driving transistor included in a pixel has a hysteresis characteristic in which a threshold voltage is shifted and a current is changed depending on a change in gate voltage. A current different from that set in the pixel flows according to a previous data voltage of the pixel due to the hysteresis characteristic of the driving transistor. Accordingly, the pixel does not generate light with a desired luminance in a current frame.

A driving method for supplying a scan signal having a plurality of scan pulses corresponding to respective pixel rows may be applied so as to minimize the hysteresis characteristic.

The above information disclosed in this Background section is only for understanding of the background of the inventive concepts, and, therefore, it may contain information that does not constitute prior art.

SUMMARY

Devices constructed and methods according to exemplary implementations of the invention provide a display device for adjusting the number of scan pulses supplied in one frame according to an image variation and a method for driving the display device.

Additional features of the inventive concepts will be set forth in the description which follows, and in part will be apparent from the description, or may be learned by practice of the inventive concepts.

According to one or more embodiments of the invention, a display device includes: a display panel including a plurality of pixels each coupled to a scan line and a data line; a scan driver configured to supply a scan signal having at least one scan pulse to the scan line; and a pulse controller configured to adjust a number of the scan pulses supplied during one frame, based on an image variation between a previous frame and a current frame.

The pulse controller may be configured to increase the number of scan pulses supplied in the one frame in response to the image variation being increased.

The pulse controller is configured to, in response to a display image being a still image, set the number of scan pulses supplied to the scan line during the one frame to be a single scan pulse.

The pulse controller may include: a frame memory configured to store image data in a frame unit; an image variation calculator configured to calculate a grayscale value variation between the image data of the previous frame and the image data of the current frame; and a pulse determiner configured to determine the number of scan pulses supplied in the current frame by comparing the grayscale value variation with preset threshold values.

The pulse determiner may be configured to: in response to the grayscale value variation being 0, determine the number of scan pulses as 1; and in response to the grayscale value variation being larger than 0, adjust the number of scan pulses according to variation ranges divided by the threshold values.

The image variation calculator may include: a first calculator configured to calculate a grayscale value difference between a grayscale of the previous frame and a grayscale of the current frame with respect to each of the pixels; and a second calculator configured to output the grayscale value variation by calculating a total sum of absolute values of the grayscale value differences.

The display device may further include: a data over-driver configured to generate a grayscale compensation value, based on the grayscale value of the previous frame, the grayscale value of the current frame, and the number of scan pulses of the scan signal.

The data over-driver may include a plurality of look-up tables configured to store the grayscale compensation value according to the grayscale value of the previous frame and the grayscale value of the current frame, and wherein one of the look-up tables is selected according to the number of scan pulses.

The data over-driver may be configured to decrease the grayscale compensation value in response to the number of scan pulses being increased under the same grayscale change condition.

The pulse controller may further include: a quantizer configured to generate a quantized image data by quantizing the image data to a preset data size and provide the quantized image data to the frame memory; and a de-quantizer configured to generate a decoded image data by decoding the quantized image data transmitted from the frame memory to an original data size and provide the decoded image data to the image variation calculator and the data over-driver.

The display device may further include: a data driver configured to: generate compensated image data by applying the grayscale compensation value to the image data; and supply a data signal corresponding to the compensated image data to the data line.

The pulse controller may include: a global feature extractor configured to extract an overall image feature of the one frame and provide the extracted overall image feature to a frame memory; the frame memory configured to store data received from the global feature extractor in a frame unit; an image variation calculator configured to calculate a feature variation between the overall image feature of the previous frame and the overall image feature of the current frame; and a pulse determiner configured to determine the number of scan pulses supplied in the current frame by comparing the feature variation with preset threshold values.

The global feature extractor may include: a first feature calculator configured to calculate a total sum of image data of the one frame to generate a first feature; and a second feature calculator configured to calculate a total sum of edge components of image data of the one frame to generate a second feature.

The frame memory may be configured to store the first feature and the second feature in the frame unit.

The variation calculator may include: a first calculator configured to calculate a total grayscale value variation that is a variation between the first feature of the previous frame and the first feature of the current frame; and a second calculator configured to calculate an edge variation that is a variation between the second feature of the previous frame and the second feature of the current frame.

The pulse determiner may be configured to: in response to the total grayscale value variation and the edge variation being 0, determine the number of scan pulses as 1; and in response to the total grayscale value variation being larger than 0, adjust the number of scan pulses according to variation ranges divided by the threshold values.

According to one or more embodiments of the invention, a method for driving a display device, the method including: calculating an image variation from image data of a previous frame and image data of a current frame; determining a number of scan pulses of a scan signal supplied to one scan line during one frame, based on the image variation; and displaying an image by supplying the scan signal and a data signal to a pixel.

The determining of the number of scan pulses may include; determining the number of scan pulses in the one frame as 1 in response to the image variation being 0.

The determining of the number of scan pulses may include; increasing the number of scan pulses in the one frame in response to the image variation being increased.

The determining of the number of scan pulses may further include: determining a grayscale compensation value, based on a grayscale of the previous frame, a grayscale of the current frame, and a number of scan pulses of the scan signal; and generating the data signal by applying the grayscale compensation value to the image data of the current frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
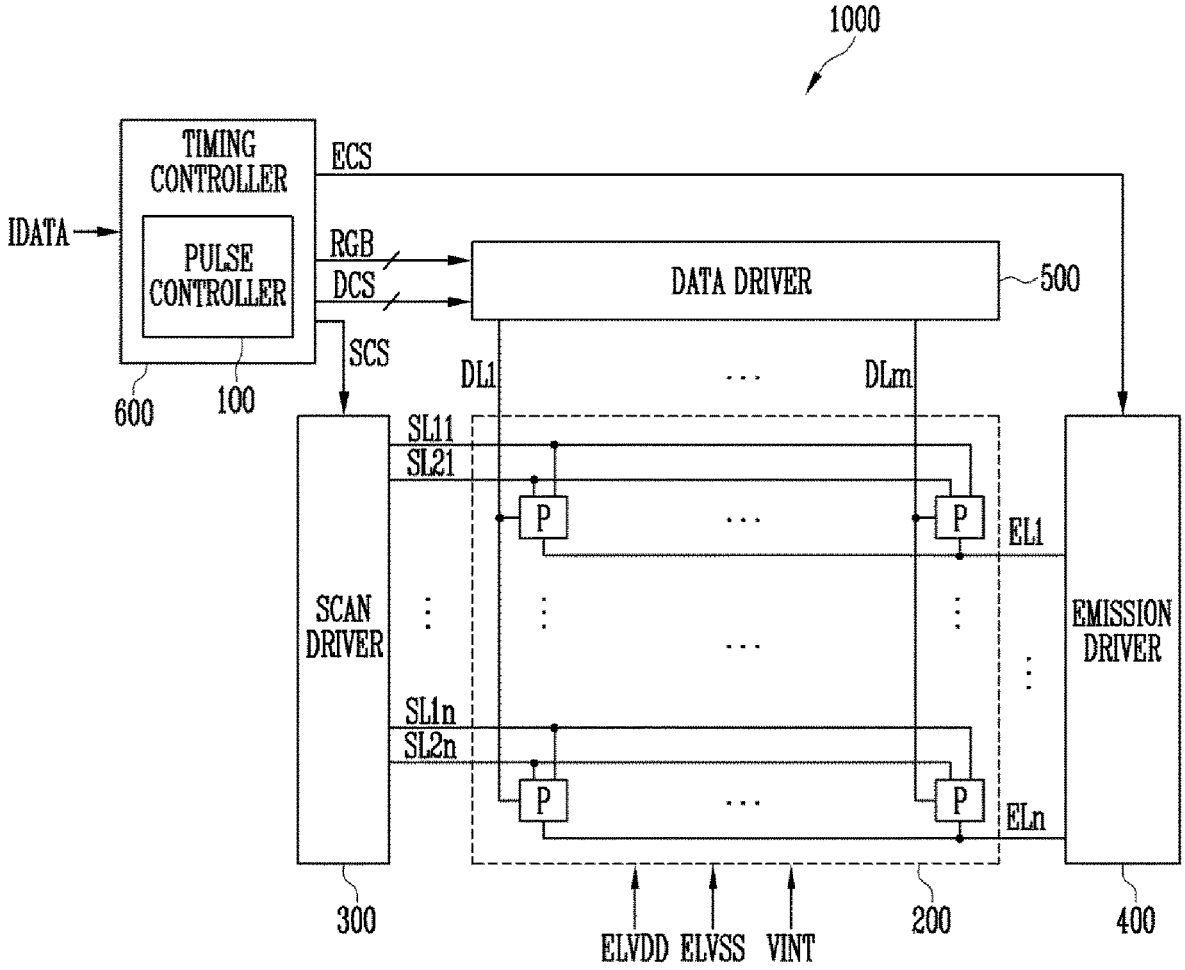
FIG. 1 is a block diagram illustrating a display device according to an exemplary embodiment of the present disclosure.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or to requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device according to an exemplary embodiment of the present disclosure.

Referring to FIG. 1, the display device 1000 may include a pulse controller 100, a display panel 200, a scan driver 300, an emission driver 400, a data driver 500, and a timing controller 600.

The pulse controller 100 may adjust the number of scan pulses of a scan signal during one frame, based on an image variation between a previous frame and a current frame. In an exemplary embodiment, the pulse controller 100 may directly control an operation of the scan driver 300.

In an exemplary embodiment, the pulse controller 100 may be included in the timing controller 600. For example, the timing controller 600 may generate a first control signal SCS for controlling an operation of the scan driver 300, based on a number of scan pulses, which is determined by the pulse controller 100.

The display panel 200 may include a plurality of scan lines SL11 to SLln and SL21 to SL2*n*, a plurality of emission control lines EL1 to ELn, and a plurality of data lines DL1 to DLm, and include a plurality of pixels P respectively coupled to the scan lines SL11 to SLln and SL21 to SL2*n*, the emission control lines EL1 to ELn, and the data lines DL1 to DLm (n and m are integers of 1 or more). Each of the pixels P may include a driving transistor and a plurality of switching transistors.

The scan driver 300 may sequentially supply a scan signal to the pixels P through the scan lines SL11 to SL1*n* and SL21 to SL2*n*, based on the first control signal SCS. The scan driver 300 receives the first control signal SCS, at least one clock signal, and the like from the timing controller 600.

In an exemplary embodiment, the first control signal SCS may be generated by the pulse controller 100.

In an exemplary embodiment, the scan signal may include a plurality of scan pulses. For example, the scan pulses may be divided into at least one bias pulse supplied in a bias period and one write pulse supplied in a data write period. The scan pulses may correspond to a gate-on voltage at which the transistors included in the pixels P are turned on.

Also, the bias pulses and the write pulse may have the same voltage level and the same pulse width. In an example, when the transistors included in the pixels P are implemented with a P-channel Metal Oxide Semiconductor (PMOS) transistor, the gate-on voltage may be set to a logic low level. When the transistors included in the pixels P are implemented with an N-channel Metal Oxide Semiconductor (NMOS) transistor, the gate-on voltage may be set to a logic high level.

A bias voltage may be applied to a driving transistor in response to the bias pulses. In an example, the bias voltage may be a data voltage corresponding to a predetermined previous pixel row.

A data voltage corresponding to actual emission of a corresponding pixel P may be applied to the driving transistor in response to the write pulse. The corresponding pixel P may emit light with a grayscale (luminance) corresponding to the data voltage.

The emission driver 400 may sequentially supply an emission control signal to the pixels P through the emission control lines EL1 to ELn, based on a second control signal ECS. The emission driver 400 receives the second control signal ECS, a clock signal, and the like from the timing controller 600. The emission control signal may divide one frame into an emission period and a non-emission period with respect to pixel rows.

The data driver 500 may receive a third control signal DCS and an image data signal RGB from the timing controller 600. The data driver 500 may supply a data signal (data voltage) to the pixels P through the data lines DL1 to DLm, based on the third control signal DCS and the image data signal RGB. For example, the data driver 500 may convert the digital image data signal RGB into an analog data voltage and supply the analog data voltage to the display panel 200. The image data signal RGB may correspond to input image data IDATA supplied from an external graphic source, etc. or data obtained by applying a compensation grayscale value generated by a data over-driver to the image data IDATA.

The timing controller 600 may control driving of the pulse controller 100, the scan driver 300, the emission driver 400, and the data driver 500, based on timing signals supplied from the outside. The timing controller 600 may supply a control signal including a scan start signal, a scan clock signal, and the like to the scan driver 300, and supply the second control signal ECS including an emission control start signal, an emission control clock signal, and the like to the emission driver 400. The third control signal DCS for controlling the data driver 500 may include a source start signal, a source output enable signal, a source sampling clock, and the like.

In an exemplary embodiment, the timing controller 600 may supply a control signal for controlling driving of the pulse controller 100 to the pulse controller 100.

At least some of the pulse controller 100, the scan driver 300, the emission driver 400, the data driver 500, and the timing controller 600 may be physically and/or functionally integrated, if necessary.

First and second power voltages ELVDD and ELVSS for emission of the pixels P and a third power voltage VINT for initialization of the pixels P may be further supplied to the display panel 200.

Figure 2:
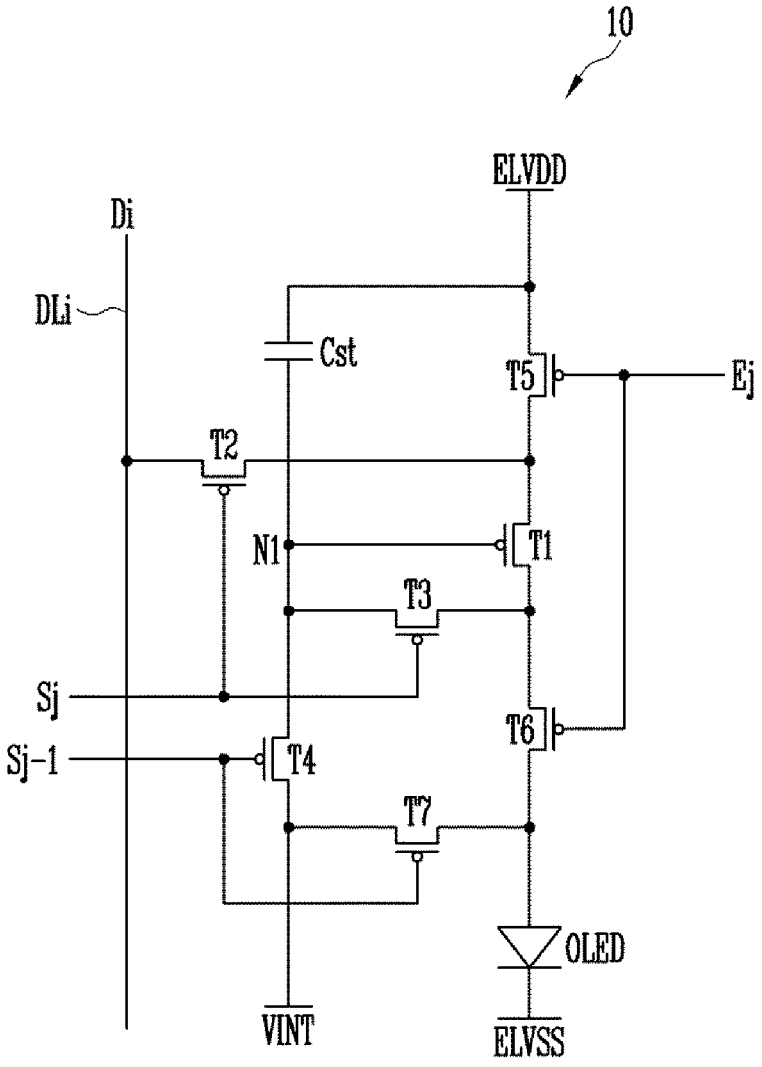
FIG. 2 is a circuit diagram illustrating an example of a pixel included in the display device shown in FIG. 1.
Figure 3:
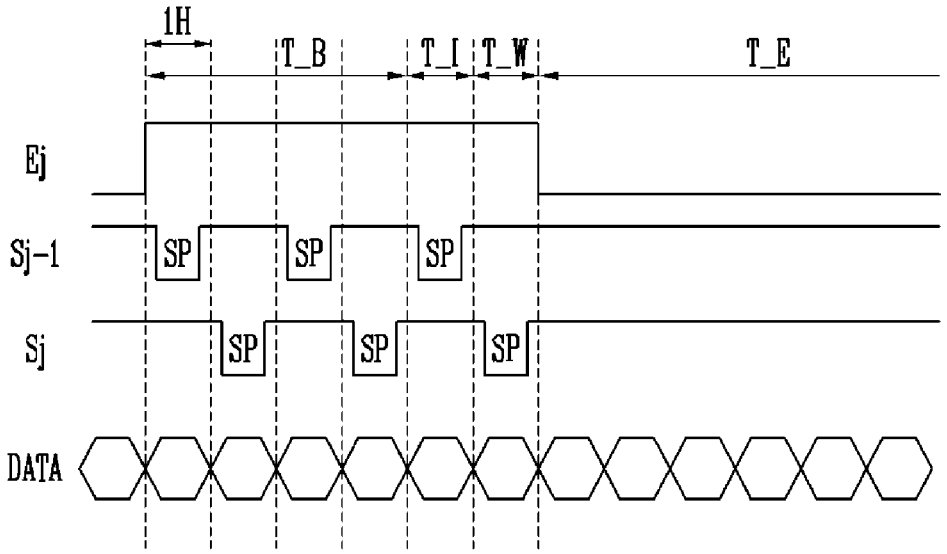
FIG. 3 is a waveform diagram illustrating an example of signals supplied to the pixel shown in FIG. 2.

FIG. 2 is a circuit diagram illustrating an example of the pixel included in the display device shown in FIG. 1. FIG. 3 is a waveform diagram illustrating an example of signals supplied to the pixel shown in FIG. 2.

For convenience of description, a pixel 10 (i.e., a (j, i) pixel) coupled to an ith data line DLi, a jth scan line, and a jth emission control line will be illustrated in FIG. 2 (wherein i and j are natural numbers).

Referring to FIGS. 2 and 3, the pixel 10 may include an organic light emitting diode OLED, first to seventh transistors T1 to T7, and a storage capacitor Cst.

An anode electrode of the organic light emitting diode OLED may be coupled to the sixth and seventh transistors T6 and T7, and a cathode electrode of the organic light emitting diode OLED may be coupled to a second power voltage ELVSS. The organic light emitting diode OLED may generate light with a predetermined luminance corresponding to an amount of current supplied from a driving transistor (i.e., the first transistor T1).

The seventh transistor T7 may be coupled between a third power voltage VINT and the anode electrode of the organic light emitting diode OLED. A gate electrode of the seventh transistor T7 may receive a previous scan signal ((j−1)th scan signal Sj−1). The seventh transistor T7 may be turned on by the (j−1)th scan signal Sj−1, to supply the third power voltage VINT to the anode electrode of the organic light emitting diode OLED.

The sixth transistor T6 may be coupled between the first transistor T1 and the organic light emitting diode OLED. A gate electrode of the sixth transistor T6 may receive a jth emission control signal Ej.

The fifth transistor T5 may be coupled between a first power voltage ELVDD and the first transistor T1. A gate electrode of the fifth transistor T5 may receive the jth emission control signal Ej.

A first electrode of the first transistor (driving transistor) T1 may be coupled to the first power voltage ELVDD via the fifth transistor T5, and a second electrode of the first transistor T1 may be coupled to the anode electrode of the organic light emitting diode OLED via the sixth transistor T6. A gate electrode of the first transistor T1 may be coupled to a first node N1. The first transistor T1 may control an amount of current flowing from the first power voltage ELVDD to the second power voltage ELVSS via the organic light emitting diode OLED, corresponding to a voltage of the first node N1.

The third transistor T3 may be coupled between the second electrode of the first transistor T1 and the first node N1. A gate electrode of the third transistor T3 may receive a jth scan signal (current scan signal) Sj. When the third transistor T3 is turned on, the first transistor T1 may be diode-coupled. Therefore, a threshold voltage compensation operation of the first transistor T1 may be performed.

The fourth transistor T4 may be coupled between the first node N1 and the third power voltage VINT. A gate electrode of the fourth transistor T4 may receive the (j−1)th scan signal Sj−1. The fourth transistor T4 may be turned on in response to the (j−1)th scan signal Sj−1, to supply the third power voltage VINT to the first node N1.

The second transistor T2 may be coupled between the data line DLi and the first electrode of the first transistor T1. A gate electrode of the second transistor T2 may receive the jth scan signal Sj. The second transistor T2 may electrically couple the data line DLi and the first electrode of the first transistor T1 in response to the jth scan signal Sj.

The storage capacitor Cst may be coupled between the first power voltage ELVDD and the first node N1. The storage capacitor Cst may store a voltage corresponding to a data signal and a threshold voltage of the first transistor T1.

However, the configuration of the pixel 10 is not limited thereto. For example, the gate electrode of the seventh transistor T7 may receive the jth scan signal or a (j+1)th scan signal.

The pixel 10 may be operated by the signals shown in FIG. 3.

First, the emission control signal Ej having a logic high level may be supplied to the emission control line, so that the fifth and sixth transistors T5 and T6 are turned off. That is, the pixel 10 is set to a non-emission state during this period.

Subsequently, during a bias period T_B, the scan signals Sj−1 and Sj each having at least one scan pulse SP may be sequentially supplied to the pixel 10. The (j−1)th scan signal Sj−1 may serve as a signal for initializing a gate voltage of the first transistor T1 and an anode voltage of the organic light emitting diode OLED to a predetermined voltage level. The jth scan signal Sj may serve as a signal for writing a data voltage DATA to the first transistor T1.

Although FIG. 3 illustrates that the number of scan pulses SP is three, the number of scan pulses SP is not limited thereto. Also, the number of scan pulses SP may be adjusted according to an image variation.

When a first scan pulse SP of the (j−1)th scan signal Sj−1 is supplied, the fourth and seventh transistors T4 and T7 may be turned on. When the fourth transistor T4 is turned on, the third power voltage VINT may be supplied to the gate electrode (first node N1) of the first transistor T1. In addition, when the seventh transistor T7 is turned on, the third power voltage VINT may be supplied to the anode electrode of the organic light emitting diode OLED. The first transistor T1 may have an on-bias state.

When a scan pulse SP of the jth scan signal Sj is supplied during the bias period T_B, the second and third transistors T2 and T3 may be turned on. When the second transistor T2 is turned on, a previous data voltage corresponding to a (j−2)th pixel row or a (j−4)th pixel row may be supplied to the first electrode of the first transistor T1. In addition, when the third transistor T3 is turned on, the first transistor T1 may be diode-coupled.

A plurality of scan pulses SP of the bias period T_B are supplied to the pixel 10, so that luminance distortion caused by a sudden grayscale change between adjacent frames can be minimized. That is, step efficiency (image conversion sufficiency) corresponding to an image data change can be increased. As described above, the method for supplying the plurality of scan pulses SP in the bias period T_B can be defined as Motion Clarity (MC) driving, and the display quality of a moving image can be improved.

However, a previous data voltage (i.e., a data voltage applied to a previous pixel row) for grayscale expression may have a value larger than that of the third power voltage VINT, and the on-bias level applied to the first transistor T1 may be changed depending on the magnitude of the previous data voltage. Therefore, a pixel at a lower stage may emit light with an unwanted luminance according to a data voltage (grayscale value) at an upper stage of the display panel 200 due to insertion of the bias period T_B (i.e., supply of the plurality of scan pulses SP).

In particular, when an image having a large grayscale value difference, such as an image including a black text, is displayed or when a still image having a large difference between upper and lower grayscales thereof is displayed, the luminance of pixels at a contour line portion may be unintentionally increased. For example, the luminance at a lower end of a black pattern may be increased due to a strong on-bias state caused by a high data voltage corresponding to a black grayscale.

Accordingly, the display device according to the exemplary embodiment of the present disclosure can adaptively adjust the number of scan pulses SP changing a bias state according to an image variation (change degree). Thus, deterioration of image quality such as a ghost phenomenon in a still image can be minimized, and step efficiency in a moving image can be increased.

Subsequently, a pixel initialization operation and a data write operation may be substantially performed. In an initialization period T_I, a scan pulse SP of the (j−1)th scan signal Sj−1 may be supplied to the pixel 10, so that the fourth and seventh transistors T4 and T7 are turned on. The initialization period T_I is a period in which the gate voltage of the first transistor T1 and the anode voltage of the organic light emitting diode OLED are substantially initialized so as to write data.

Subsequently, in a write period T_W, a scan pulse SP of the jth scan signal Sj may be supplied to the pixel 10, and a data voltage DATA (Di of FIG. 2) corresponding to the pixel 10 may be supplied to the first electrode of the driving transistor T1.

However, this is merely illustrative, the initialization period T_I and the write period T_W means a period in which the last scan pulse SP in a non-emission period is supplied. For example, when the scan signal Sj−1 or Sj has only one scan pulse SP, the non-emission period is not included in the bias period T_B but includes only the initialization period T_I and the write period T_W.

Subsequently, in an emission period T_E, the jth emission control signal Ej has a logic low level, and the fifth and sixth transistors T5 and T6 may be turned on. Accordingly, the organic light emitting diode OLED can emit light with a grayscale corresponding to the data voltage Di.

Figure 4:
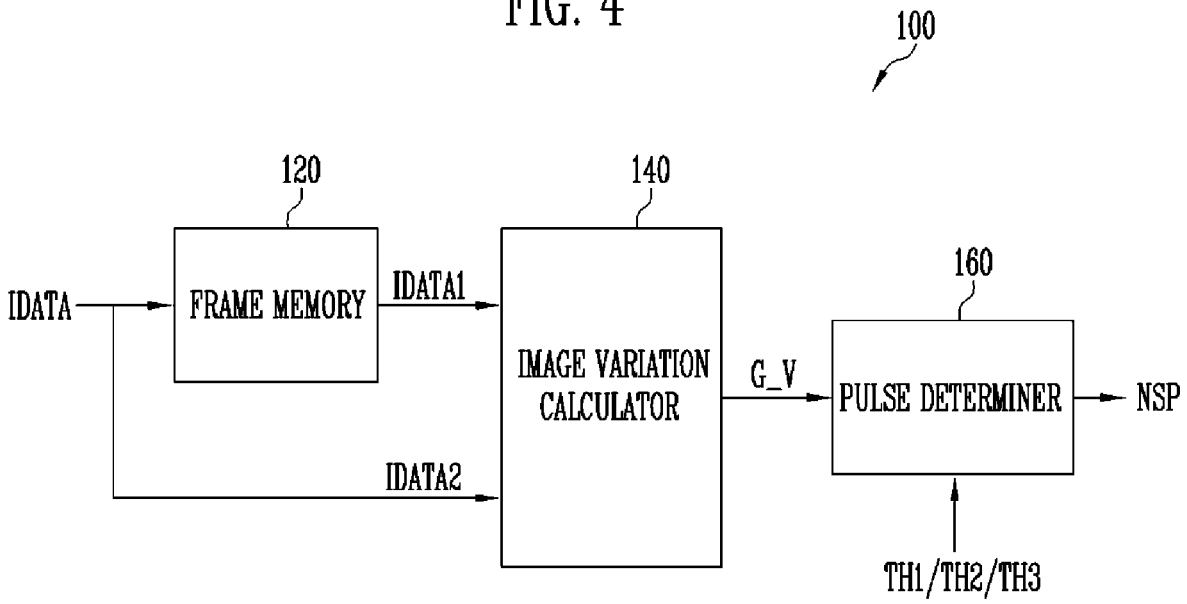
FIG. 4 is a block diagram illustrating an example of a pulse controller included in the display device shown in FIG. 1.
Figure 5:
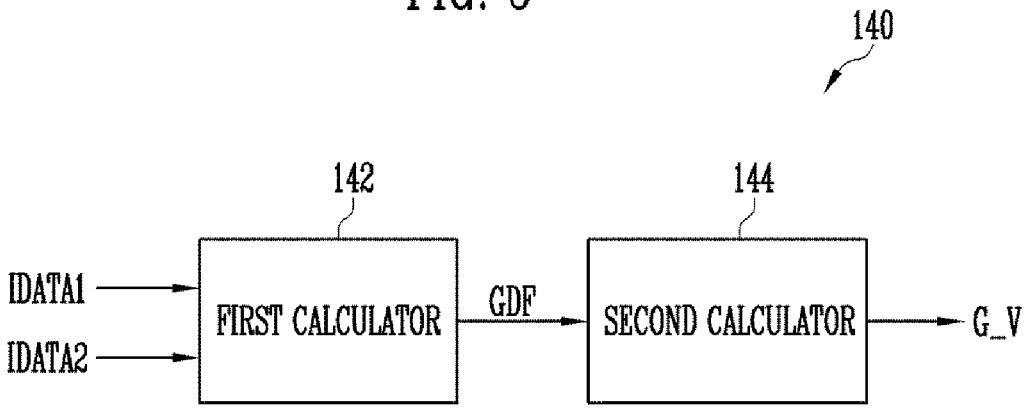
FIG. 5 is a block diagram illustrating an example of an image variation calculator included in the pulse controller shown in FIG. 4.

FIG. 4 is a block diagram illustrating an example of the pulse controller included in the display device shown in FIG. 1. FIG. 5 is a block diagram illustrating an example of an image variation calculator included in the pulse controller shown in FIG. 4.

Referring to FIGS. 1, 2, 3, 4, and 5, the pulse controller 100 may include a frame memory 120, an image variation calculator 140, and a pulse determiner 160.

The pulse controller 100 may adjust a number NSP of scan pulses during one frame, based on an image variation between a previous frame and a current frame. In an exemplary embodiment, when the image variation increases, the number of scan pulses SP in one frame may increase. When a display image is a still image, one scan pulse SP may be supplied to each of the scan lines during one frame.

The frame memory 120 may store image data IDATA in a frame unit. In an exemplary embodiment, the frame memory 120 may be implemented with a Random Access Memory (RAM) capable of image data IDATA corresponding to one frame. For example, the frame memory 120 may store and output the image data IDATA without loss of data.

The image data IDATA output from the frame memory 120 may be image data IDATA1 of the previous frame. Image data IDATA2 of the current frame may be simultaneously provided to the image variation calculator 140 while being provided to the frame memory 120.

The image variation calculator 140 may calculate a grayscale value variation G_V between the image data IDATA1 of the previous frame and the image data IDATA2 of the current frame. In an exemplary embodiment, as shown in FIG. 5, the image variation calculator 140 may include a first calculator 142 and a second calculator 144.

In an exemplary embodiment, the image data IDATA1 and IDATA2 may include grayscale values corresponding to each of the pixels P. When a grayscale is expressed with 8 bits, each pixel P may be expressed with 256 grayscales, and the image data IDATA1 and IDATA2 may include grayscale data corresponding to the 256 grayscales.

The first calculator 142 may calculate a grayscale value difference between a grayscale of the previous frame and a grayscale of the current frame with respect to each of the pixels P. In an exemplary embodiment, the first calculator 142 may calculate grayscale value differences with respect to all the pixels P. For example, the first calculator 142 may calculate absolute values GDF of the grayscale value differences, and provide the calculated absolute values GDF to the second calculator 144.

The second calculator 144 may output a grayscale value variation G_V by calculating a total sum of the absolute values GDF of the grayscale value differences. The grayscale value variation G_V may be an accumulated value of grayscale value differences for each pixel.

When a still image is displayed, no change of the image exists, and the grayscale value variation G_V may be 0. When the change of the image increases, the grayscale value variation G_V may increase. For example, when the grayscale value difference in a specific pixel increases or when the number of pixels P having a grayscale change increases, the grayscale value variation G_V may increase.

The pulse determiner 160 may determine a number NSP of scan pulses supplied in the current frame by comparing the grayscale value variation G_V with preset threshold values TH1, TH2, and TH3. For example, when three threshold values TH1, TH2, and TH3 are provided, four variation ranges may be set, and the number NSP of scan pulses may be determined as one of 1 to 4. However, this is merely illustrative, and the number of threshold values and the number of scan pulses are not limited thereto. For example, one scan signal supplied in one frame according to the grayscale value variation G_V may include a maximum of 7 or 8 scan pulses.

In an exemplary embodiment, when the grayscale value variation G_V is 0, the pulse determiner 160 may determine the number NSP of scan pulses as 1. When the grayscale value variation G_V is larger than 0, the pulse determiner 160 may adjust the number NSP of scan pulses according to variation ranges divided by the threshold values TH1, TH2, and TH3.

For example, according to a change in variation range, the number NSP of scan pulses may increase when the grayscale value variation G_V increases. Accordingly, when an image change is severe, the number NSP of scan pulses increases, so that step efficiency can be improved.

As described above, the display device 1000 according to the exemplary embodiment of the present disclosure can adaptively change the number NSP of scan pulses applied in one frame, corresponding to an image variation (or grayscale value variation G_V) between adjacent frames. Thus, deterioration of display quality such as a luminance ghost phenomenon in a still image and an image having a very low image change can be minimized, and step efficiency in a moving image can be improved.

Figure 6A:
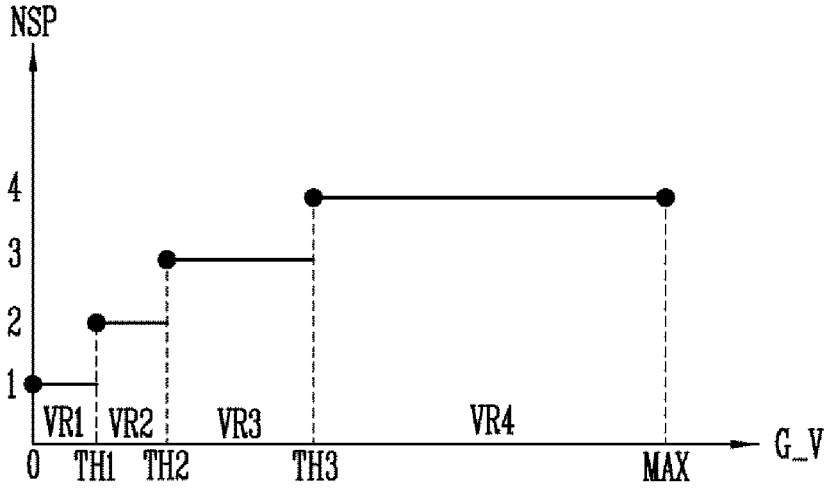
FIGS. 6A, 6B, and 6C are diagrams illustrating examples of a scan pulse determined according to a grayscale value variation.
Figure 6B:
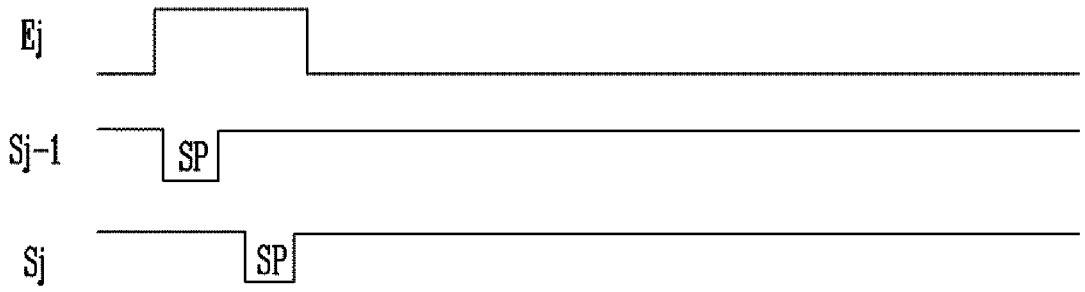
Figure 6C:
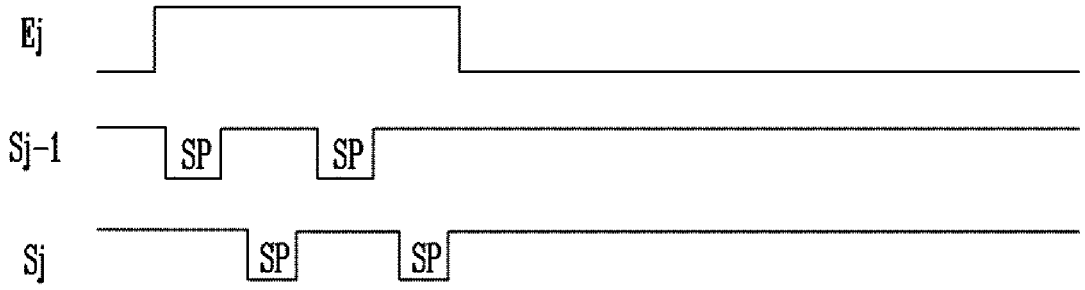

FIGS. 6A, 6B, and 6C are diagrams illustrating examples of a scan pulse determined according to a grayscale value variation.

Referring to FIGS. 1, 2, 3, 4, 5, 6A, 6B, and 6C, the pulse controller 100 (or the pulse determiner 160) may determine a number NSP of scan pulses supplied in a current frame by comparing the grayscale value variation V_G with the threshold values TH1, TH2, and TH3.

As shown in FIG. 6A, the grayscale value variation G_V may be divided into first to fourth variation ranges by first to third threshold values TH1, TH2, and TH3. For example, a maximum grayscale value variation MAX may correspond to a grayscale value variation when all the pixels P are changed from the lowest grayscale value (e.g., 0) to the highest grayscale value (e.g., 255) or a grayscale value variation when all the pixels P are changed from the highest grayscale to the lowest grayscale.

In an exemplary embodiment, the first threshold value TH1 may be about 5% of the maximum grayscale value variation MAX, the second threshold value TH2 may be about 10% of the maximum grayscale value variation MAX, and the third threshold value TH3 may be about 20% of the maximum grayscale value variation MAX.

When the grayscale value variation G_V is 0, the number NSP of scan pulses may be 1. In addition, a number NSP of scan pulses, which corresponds to the first variation range VR1, may be 1. A number NSP of scan pulses, which corresponds to the second variation range VR2, may be 2, a number NSP of scan pulses, which corresponds to the third variation range VR3, may be 3, and a number NSP of scan pulses, which corresponds to the fourth variation range VR4, may be 4. The display device 1000 including the pulse controller 100 set as described above can output a scan signal including a maximum of four scan pulses.

However, this is merely illustrative, the threshold values TH1, TH2, and TH3, the variation ranges VR1, VR2, VR3, and VR4, and the numbers NSP of scan pulses, which correspond to the variation ranges VR1, VR2, VR3, and VR4, are not limited thereto. For example, scan pulses SP corresponding to three or five variation ranges may be set.

For example, as shown in FIG. 6B, one scan pulse SP may be applied to a jth pixel P during one frame with respect to a still image. In addition, when the grayscale value variation G_V is included in the second variation range VR2, two scan pulses SP may be applied to the jth pixel P during one frame as shown in FIG. 6C. In an exemplary embodiment, the length of an emission range may be shortened when the number of scan pulses SP applied in one frame increases.

Figure 7:
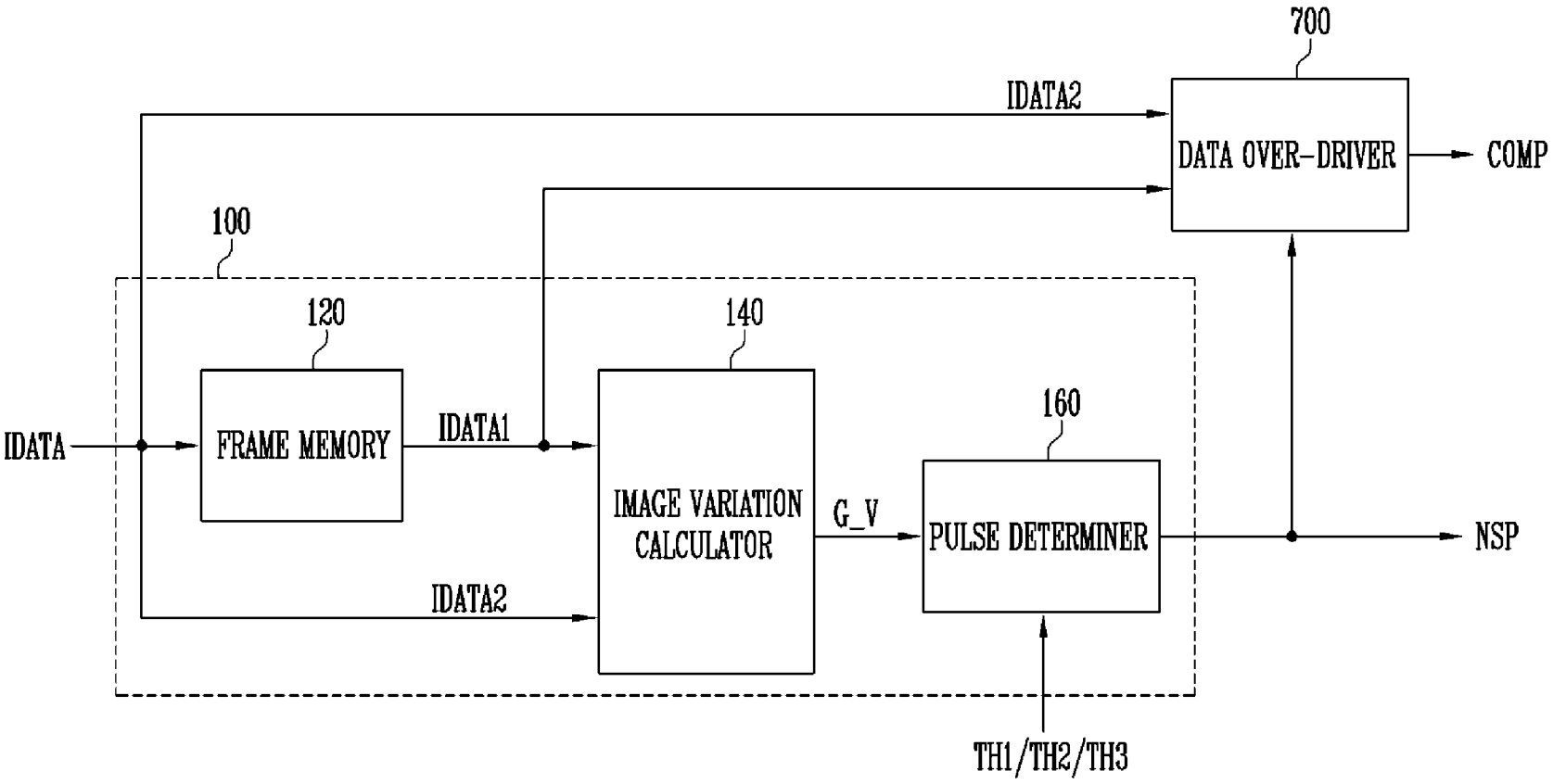
FIG. 7 is a block diagram illustrating an example of the pulse controller included in the display device shown in FIG. 1 and a data over-driver.
Figure 8:
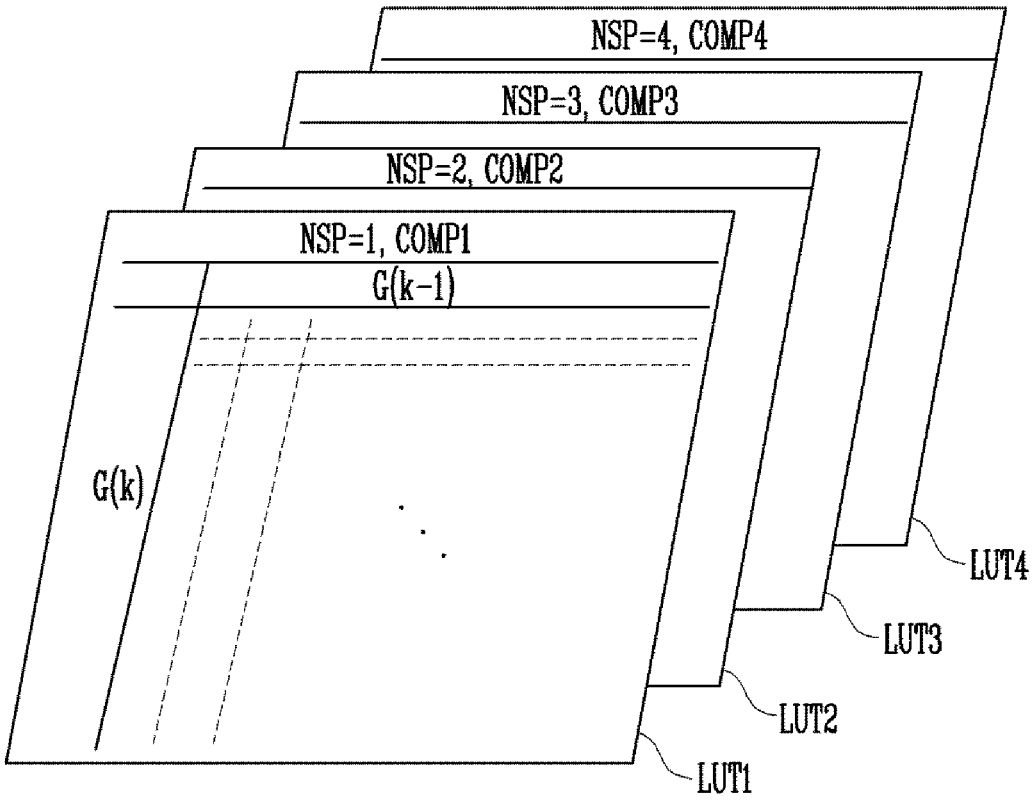
FIG. 8 is a diagram illustrating an example of the data over-driver shown in FIG. 7.

FIG. 7 is a block diagram illustrating an example of the pulse controller included in the display device shown in FIG. 1 and a data over-driver. FIG. 8 is a diagram illustrating an example of the data over-driver shown in FIG. 7.

The display device according to this embodiment is substantially identical to that shown in FIGS. 1, 2, 3, 4, and 5 except the configuration of a data over-driver. Therefore, components identical or corresponding to those of the display device shown in FIGS. 1, 2, 3, 4, and 5 are designated by like reference numerals, and their overlapping descriptions will be omitted.

Referring to FIGS. 1, 2, 3, 4, 5, 7, and 8, the display device 1000 may include a pulse controller 100, a display panel 200, a scan driver 300, an emission driver 400, a data driver 500, a timing controller 600, and a data over-driver 700.

The pulse controller 100 may adjust the number of scan pulses of a scan signal during one frame, based on an image variation between a previous frame and a current frame. In an exemplary embodiment, the pulse controller 100 may include a frame memory 120, an image variation calculator 140, and a pulse determiner 160.

The frame memory 120 may store image data IDATA in a frame unit. The image variation calculator 140 may calculate a grayscale value variation G_V between the image data IDATA1 of the previous frame and the image data IDATA2 of the current frame. The pulse determiner 160 may determine a number NSP of scan pulses supplied in the current frame by comparing the grayscale value variation G_V with preset threshold values TH1, TH2, and TH3.

In an exemplary embodiment, the pulse determiner 160 may provide the calculated number NSP of scan pulses corresponding to the current frame to the data over-driver 700.

In an exemplary embodiment, the data over-driver 700 may output a grayscale compensation value COMP, based on a grayscale G(k−1) of the previous frame, a grayscale G(k) of the current frame, and the number NSP of scan pulses with respect to each pixel P. The grayscale compensation value COMP may compensate for a grayscale value of the corresponding pixel P. For example, the grayscale compensation value COMP may be applied to current image data IDATA2 of each pixel P. The grayscale compensation value COMP may be changed depending on the pixels P or predetermined pixel groups.

Image data to which the grayscale compensation value COMP may be converted into an analog data signal. A voltage higher than that corresponding to the original image data is applied by the grayscale compensation value COMP, so that the response speed of the pixel P can be improved. That is, the data over-driver 700 can further improve the display quality of a moving image by additionally complementing MC driving.

In an exemplary embodiment, the data over-driver 700 may include a plurality of look-up tables LUT1, LUT2, LUT3, and LUT4 that store grayscale compensation values COMP according to a grayscale of the previous frame and a grayscale of the current frame. For example, the look-up tables LUT1, LUT2, LUT3, and LUT4 may correspond to the variation ranges (VR1, VR2, VR3, and VR4 of FIG. 6A), respectively. That is, one of the look-up tables LUT1, LUT2, LUT3, and LUT4 may be selected corresponding to the number NSP of scan pulses.

For example, a first look-up table LUT1 may be used when the number NSP of scan pulses is 1, and a second look-up table LUT2 may be used when the number NSP of scan pulses is 2. Similarly, a third look-up table LUT3 may be used when the number NSP of scan pulses is 3, and a fourth look-up table LUT4 may be used when the number NSP of scan pulses is 4.

However, this is merely illustrative, and the method for generating grayscale compensation values COMP is not limited thereto. For example, the data over-driver 700 may include various hardware and/or software components for calculating grayscale compensation values COMP, using the grayscale G(k−1) of the previous frame, the grayscale G(k) of the current frame, and the number NSP of scan pulses.

In an exemplary embodiment, the grayscale compensation value COMP may be generated only when the grayscale of the current frame is larger than that of the previous frame. Also, the grayscale compensation value COMP may be set not to exceed a preset maximum value.

In an exemplary embodiment, the grayscale compensation value COMP may decrease when the number NSP of scan pulses increases under the same grayscale change condition. For example, when grayscale values are changed from 0 to 100, the grayscale compensation value COMP may be changed depending on the number NSP of scan pulses. In an example, a grayscale compensation value COMP2 of the second look-up table LUT2 may be determined as about 80% (COMP2=0.8*COMP1) of grayscale compensation value COMP1 of the first look-up table LUT1. Similarly, a grayscale compensation value COMP3 of the third look-up table LUT3 may be about 60% (COMP3=0.6*COMP1) of the grayscale compensation value COMP1 of the first look-up table LUT1, and a grayscale compensation value COMP4 of the fourth look-up table LUT4 may be about 40% (COMP4=0.4*COMP1) of the grayscale compensation value COMP1 of the first look-up table LUT1.

In an exemplary embodiment, the data driver 500 may supply, to a data line, a data signal corresponding to compensated image data obtained by applying the grayscale compensation value COMP to the image data IDATA.

As described above, the display device 1000 according to the exemplary embodiment of the present disclosure simultaneously perform MC driving for controlling a scan signal and driving of the data over-driver for controlling the magnitude of a data voltage according to the number NSP of scan pulses, so that the display quality of still and moving images can be further improved.

Figure 9:
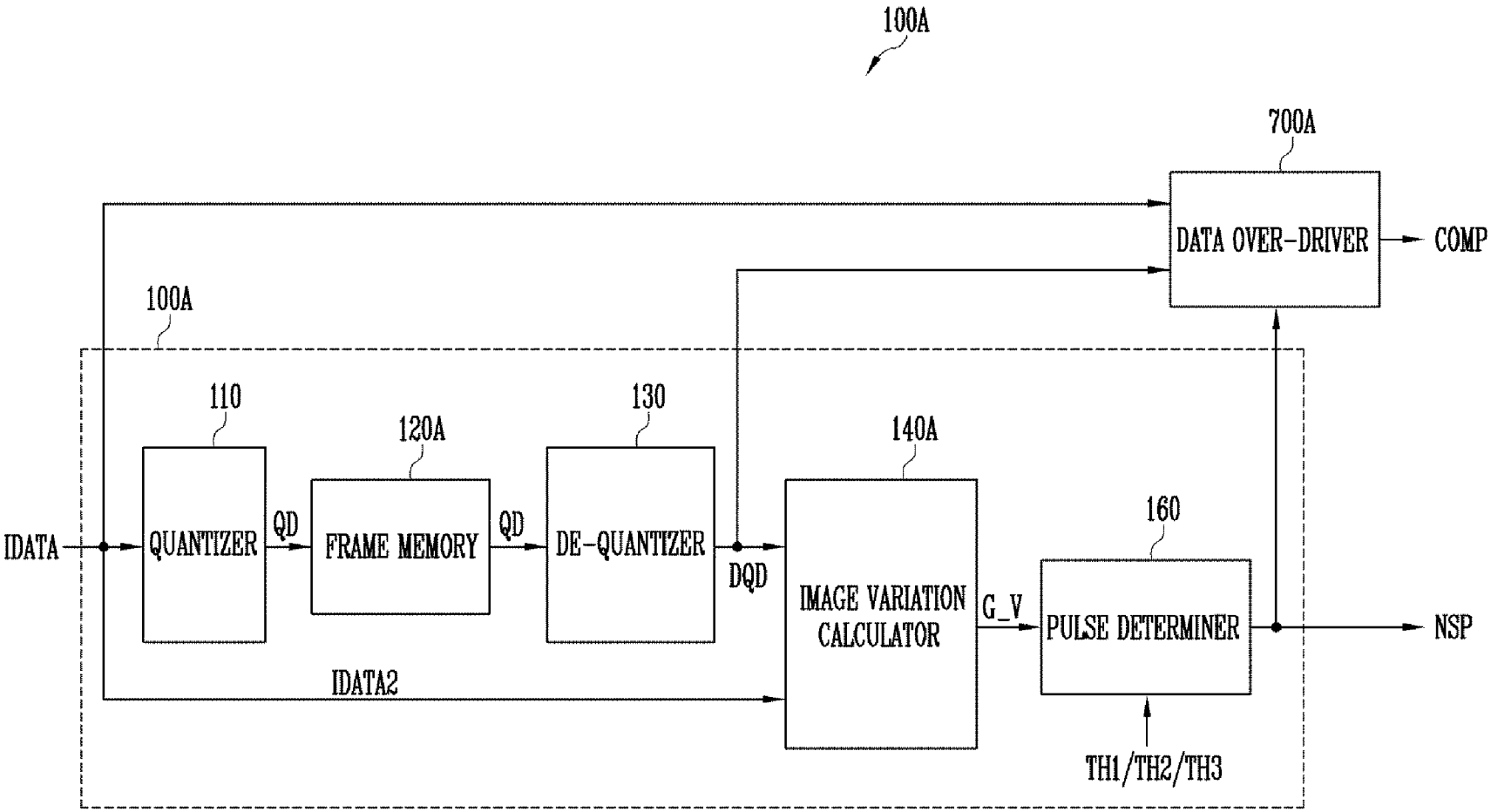
FIG. 9 is a block diagram illustrating an example of the pulse controller included in the display device shown in FIG. 1 and a data over-driver.

FIG. 9 is a block diagram illustrating an example of the pulse controller included in the display device shown in FIG. 1 and a data over-driver.

Referring to FIGS. 1, 7, 8, and 9, the display device 1000 may include a pulse controller 100A, a display panel 200, a scan driver 300, an emission driver 400, a data driver 500, a timing controller 600, and a data over-driver 700A.

In an exemplary embodiment, the pulse controller 100A may include a frame memory 120A, an image variation calculator 140A, a pulse determiner 160, a quantizer 110, and a de-quantizer 130.

The quantizer 110 may quantize image data IDATA to a preset data size. The quantizer 110 may decrease the size of the image data IDATA and provide the image data IDATA having the decreased size to the frame memory 120A. For example, when the size of the image data IDATA is 8 bits ($2^8$), the quantizer 110 may realign the image data of 8 bits to data of a 2-bit ($2^2$) range. In an example, image data IDATA of grayscale values 0 to 32 may be quantized to a digital value of 1, image data IDATA of grayscale values 33 to 64 may be quantized to a digital value of 2, image data IDATA of grayscale values 65 to 110 may be quantized to a digital value of 3, and image data IDATA of grayscale values 111 to 255 may be quantized to a digital value of 4.

Accordingly, the size of the image data IDATA is decreased, and the capacity of the frame memory 120A storing the image data IDATA can also be reduced.

However, this is merely illustrative, and the rate at which the quantizer 110 decrease the size of the image data IDATA is not limited thereto.

The de-quantizer 130 may decode quantized image data QD output from the frame memory 120A to an original data size. The decoded image data DQD may be provided to the image variation calculator 140A and the data over-driver 700A. For example, quantized image data QD of 2 bits may be converted into decoded image data DQD of 8 bits. Grayscales 0 to 32 of the original image data IDATA may be decoded to a first grayscale value (e.g., 16). That is, a plurality of grayscales may be output as one grayscale value. Similarly, grayscale values 33 to 64 of the original image data IDATA may be decoded to a second grayscale value (e.g., 48), grayscale values 65 to 110 of the original image data IDATA may be decoded to a third grayscale value (e.g., 88), and grayscale values 111 to 255 of the original image data IDATA may be decoded to a fourth grayscale value (e.g., 183).

That is, image data IDATA of a previous frame may be partially distorted by the quantizer 110 and the de-quantizer 130. However, since the distorted image data is used only to determine a scan pulse SP and a compensation grayscale value COMP, the distorted image data does not have great influence on a display image.

Decoded image data DQD corresponding to the image data IDATA of the previous frame may be provided together with image data IDATA2 of a current frame to the image variation calculator 140A.

The image variation calculator 140A may calculate a grayscale value variation G_V, based on the difference between the decoded image data DQD and the image data IDATA2 of the current frame. The pulse determiner 160 may determine a number NSP of scan pulses supplied in the current frame by comparing the grayscale value variation G_V with preset threshold values TH1, TH2, and TH3.

The data over-driver 700A may output a grayscale compensation value COMP, based on the decoded image data DQD corresponding to the image data IDATA of the previous frame, the image data IDATA2 of the current frame, and the number NSP of scan pulses.

Operations and functions of the image variation calculator 140A, the pulse determiner 160, and the data over-driver 700A, which are shown in FIG. 9, are substantially identical to those described with reference to FIGS. 4 and 7, and therefore, their overlapping descriptions will be omitted.

As described above, in the display device shown in FIG. 9, the size of the image data IDATA stored in the frame memory 120A is decreased, so that the size and capacity of the frame memory 120A can be reduced. Thus, the manufacturing cost of the display device can be reduced.

Figure 10:
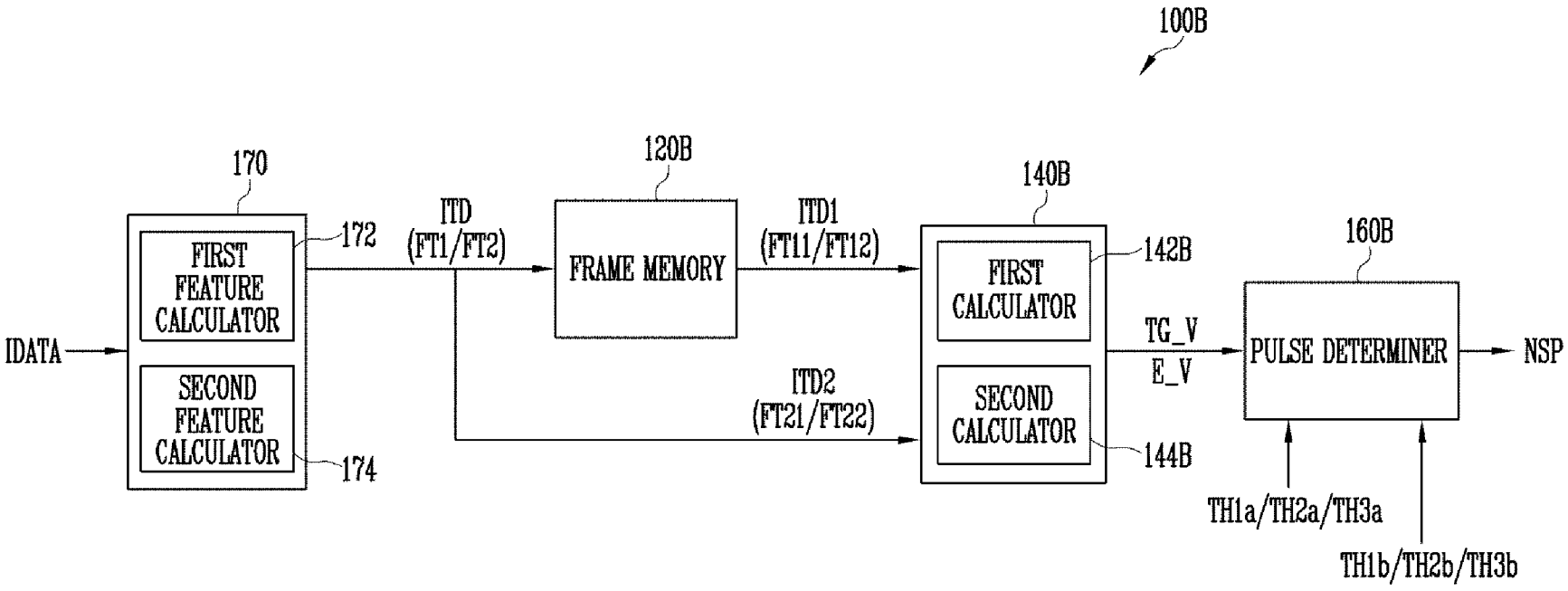
FIG. 10 is a block diagram illustrating an example of the pulse controller included in the display device shown in FIG. 1.

FIG. 10 is a block diagram illustrating an example of the pulse controller included in the display device shown in FIG. 1.

The pulse controller according to this embodiment is substantially identical to the pulse controller shown in FIGS. 4 and 5 except the configuration of a global feature extractor. Therefore, components identical or corresponding to those of the pulse controller shown in FIGS. 4 and 5 are designated by like reference numerals, and their overlapping descriptions will be omitted.

Referring to FIGS. 1, 2, 3, 4, and 5 and 10, the pulse controller 100B may include a global feature extractor 170, a frame memory 120B, an image variation calculator 140B, and a pulse determiner 160B.

The global feature extractor 170 may extract an image feature ITD of one frame and provide the extracted image feature ITD to the frame memory 120B. In an exemplary embodiment, the image feature ITD may include a first feature FT1 that is a total sum of overall image data IDATA and a second feature FT2 that is a total sum of edge components of the image data IDATA.

The global feature extractor 170 schematically predicts an image change, to reduce a load of the frame memory 120B.

In an exemplary embodiment, the global feature extractor 170 may include a first feature calculator 172 and a second feature calculator 174.

The first feature calculator 172 may calculate a first feature FT1 that is a total sum of image data IDATA of one frame. For example, the first feature calculator 172 may calculate a total sum of RGB grayscales included in the image data IDATA.

The second feature calculator 174 may calculate a second feature FT2 that is a total sum of edge components of the image data IDATA of the one frame. The edge component may be a contour line portion having a large grayscale value difference or luminance difference. In an exemplary embodiment, the second feature FT2 may be calculated by a filter algorithm such as a Sobel mask or a Prewitt mask. However, this is merely illustrative, and the second feature calculator 174 may be omitted so as to further reduce the load of the frame memory 120.

The frame memory 120B may store, in a frame unit, the first feature FT1 and the second feature FT2 instead of the overall image data IDATA.

The image variation calculator 140B may calculate a variation between an image feature ITD1 of a previous frame and an image feature ITD2 of a current frame. In an exemplary embodiment, the image variation calculator 140B may include a first calculator 142B and a second calculator 144B.

The first calculator 142B may calculate a total grayscale value variation TG_V that is a variation between a first feature FT11 of the previous frame and a first feature FT12 of the current frame. Since the first features FT11 and FT12 become a grayscale sum of the overall image data IDATA, the first features FT11 and FT12 are different from the absolute values GDF of grayscale value differences, which are shown in FIG. 5. For example, although an image is converted, the total grayscale value variation TG_V may be 0.

Therefore, the second calculator 144B is subsidiarily necessary so as to enhance the accuracy when an image change is determined. The second calculator 144B may calculate an edge variation E_V that is a variation between a second feature F21 of the previous frame and a second feature FT22 of the current frame. Movement of an image may be detected from the edge variation E_V. Therefore, the pulse determiner 160B may determine whether the image is a still image or moving image, based on the total grayscale value variation TG_V and the edge variation E_V, and determine a variation of the image.

The pulse determiner 160B may determine a number NSP of scan pulses supplied in the current frame by comparing a feature variation (i.e., the total grayscale value variation TG_V) and the edge variation E_V with preset threshold values TH1*a* to TH3*a* and TH1*b*, TH2*b*, and TH3*b*.

In an exemplary embodiment, when the total grayscale value variation TG_V and the edge variation E_V are 0, the pulse determiner 160B may determine the number NSP of scan pulses as 1. When the total grayscale value variation TG_V is larger than 0, the pulse determiner 160B may adjust the number NSP of scan pulses according to variation ranges divided by the threshold values TH1*a* to TH3*a* and TH1*b*, TH2*b*, and TH3*b*.

In an exemplary embodiment, first to third grayscale threshold values TH1*a* to TH3*a* may be compared with the total grayscale value variation TG_V, and first to third edge threshold values TH1*b*, TH2*b*, and TH3*b* may be compared with the edge variation E_V. For example, the number NSP of scan pulses may be determined based on the comparison result between the first to third grayscale threshold values TH1*a* to TH3*a* and the total grayscale value variation TG_V and the comparison result between the first to third edge threshold values TH1*b*, TH2*b*, and TH3*b* and the edge variation E_V.

For example, the number NSP of scan pulses may increase when the total grayscale value variation TG_V and/or the edge variation E_V increases.

However, this is merely illustrative, and the method for calculating the number NSP of scan pulses, based on the image feature ITD, is not limited thereto.

In an exemplary embodiment, a grayscale value variation and/or an edge variation may be calculated, stored, and compared in a pixel row unit and/or a pixel column unit. An image change degree may be analyzed based on the above-described algorithm, and the number NSP of scan pulses may be determined based on the analysis result.

Meanwhile, driving of the data over-driver may be performed based on the number NSP of scan pulses, which is output from the pulse controller 100B shown in FIG. 10.

As described above, the pulse controller 100B according to the exemplary embodiment of the present disclosure can adaptively adjust the number NSP of scan pulses according to an image change while reducing the load and size of the frame memory 120B.

Figure 11:
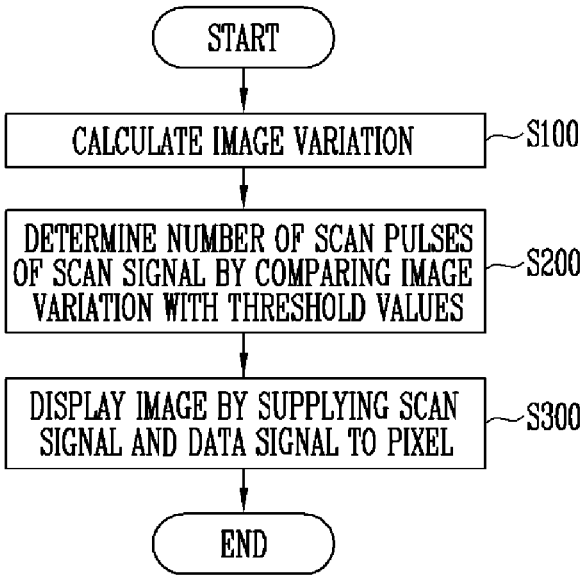
FIG. 11 is a flowchart illustrating a method for driving the display device according to an exemplary embodiment of the present disclosure.
Figure 12:
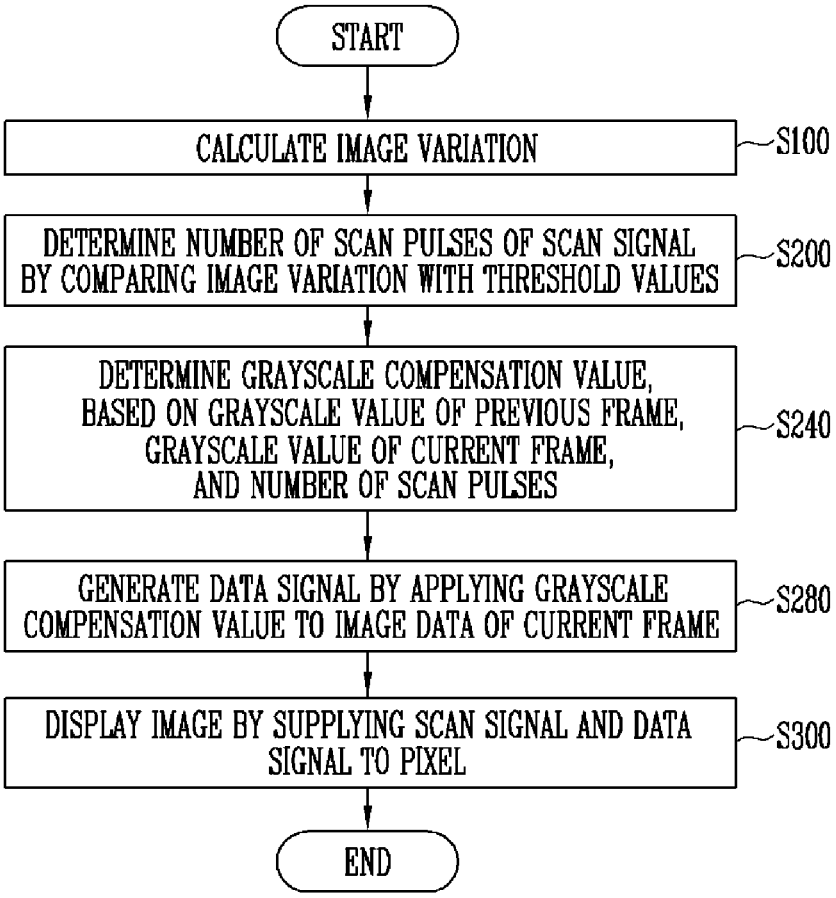
FIG. 12 is a flowchart illustrating an example of the method for driving the display device shown in FIG. 1.

FIG. 11 is a flowchart illustrating a method for driving the display device according to an exemplary embodiment of the present disclosure. FIG. 12 is a flowchart illustrating an example of the method for driving the display device shown in FIG. 1.

Referring to FIGS. 11 and 12, in the method for driving the display device, an image variation may be calculated from image data of a previous frame and image data of a current frame (S100), a number of scan pulses of a scan signal supplied to one scan line during one frame may be determined based on the image variation (S200), and an image may be displayed by supplying the scan signal and a data signal to a pixel (S300).

In an exemplary embodiment, when the image variation is 0, the number of scan pulses in the one frame may be determined as 1. In addition, the number of scan pulses in the one frame may increase when the image variation increases.

Thus, deterioration of display quality such as a luminance ghost phenomenon in a still image and an image having a very low image change can be minimized, and step efficiency in a moving image can be improved.

In an exemplary embodiment, the method for determining the number of scan pulses of the scan signal supplied to the one scan line during one frame, based on the image variation (S200) may include: determining a grayscale compensation value, based on a grayscale of the previous frame, a grayscale of the current frame, and a number of scan pulses with respect to each pixel (S240); and generating a data signal by applying the grayscale compensation value to the image data of the current frame (S280).

As described above, the number of scan pulses and the grayscale compensation value for data over-driving are adaptively adjusted according to the image variation, so that the display quality of still and moving images can be considerably improved.

However, a detailed method for driving the display device has been described in detail with reference to FIGS. 1, 2, 3, 4, 5, 6A, 6B, 6C, 7, 8, 9, and 10, and overlapping descriptions will be omitted.

As described above, in the method for driving the display device according to the exemplary embodiment of the present disclosure, the number of scan pulses is adaptively adjusted according to an image variation, so that the display quality of still and moving images can be considerably improved.

In the display device and the method for driving the same according to the present disclosure, the number of scan pulses applied in one frame can be adaptively changed corresponding to an image variation (or grayscale value variation) between adjacent frames. Thus, deterioration of display quality such as a luminance ghost phenomenon in a still image (and an image having a very low image change) can be minimized, and step efficiency in a moving image can be improved. Accordingly, the display quality of still and moving images can be improved.

Further, in the display device and the method for driving the same according to the present disclosure, driving of the data over-driver for controlling the magnitude of a data voltage according to the number of scan pulses adaptively adjusted is simultaneously performed, so that the display quality of still and moving images can be further improved.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel comprising a plurality of pixels each coupled to a scan line and a data line;

a scan driver configured to supply a scan signal having at least one scan pulse to the scan line; and a pulse controller configured to adjust a number of the scan pulses supplied during one frame, based on an image variation between a previous frame and a current frame, wherein the pulse controller is configured to increase the number of scan pulses supplied in the one frame in response to the image variation being increased.

2. The display device of claim 1, wherein, when the pulse controller is configured to, in response to a display image being a still image, set the number of scan pulses supplied to the scan line during the one frame to be a single scan pulse.

3. The display device of claim 1, wherein the pulse controller comprises:

a frame memory configured to store image data in a frame unit;

an image variation calculator configured to calculate a grayscale value variation between the image data of the previous frame and the image data of the current frame; and a pulse determiner configured to determine the number of scan pulses supplied in the current frame by comparing the grayscale value variation with preset threshold values.

4. The display device of claim 3, wherein the image variation calculator comprises:

a first calculator configured to calculate a grayscale value difference between a grayscale of the previous frame and a grayscale of the current frame with respect to each of the pixels; and a second calculator configured to output the grayscale value variation by calculating a total sum of absolute values of the grayscale value differences.

5. The display device of claim 3, further comprising:

a data over-driver configured to generate a grayscale compensation value, based on the grayscale value of the previous frame, the grayscale value of the current frame, and the number of scan pulses of the scan signal.

6. The display device of claim 5, wherein the data over-driver comprises a plurality of look-up tables configured to store the grayscale compensation value according to the grayscale value of the previous frame and the grayscale value of the current frame, and wherein one of the look-up tables is selected according to the number of scan pulses.

7. The display device of claim 5, wherein the data over-driver is configured to decrease the grayscale compensation value in response to the number of scan pulses being increased under the same grayscale change condition.

8. The display device of claim 5, wherein the pulse controller further comprises:

a quantizer configured to generate a quantized image data by quantizing the image data to a preset data size and provide the quantized image data to the frame memory; and a de-quantizer configured to generate a decoded image data by decoding the quantized image data transmitted from the frame memory to an original data size and provide the decoded image data to the image variation calculator and the data over-driver.

9. The display device of claim 5, further comprising: a data driver configured to:

generate compensated image data by applying the grayscale compensation value to the image data; and supply a data signal corresponding to the compensated image data to the data line.

10. The display device of claim 1, wherein the pulse controller comprises:

a global feature extractor configured to extract an overall image feature of the one frame and provide the extracted overall image feature to a frame memory;

the frame memory configured to store data received from the global feature extractor in a frame unit;

an image variation calculator configured to calculate a feature variation between the overall image feature of the previous frame and the overall image feature of the current frame; and a pulse determiner configured to determine the number of scan pulses supplied in the current frame by comparing the feature variation with preset threshold values.

11. The display device of claim 10, wherein the global feature extractor comprises:

a first feature calculator configured to calculate a total sum of image data of the one frame to generate a first feature; and a second feature calculator configured to calculate a total sum of edge components of image data of the one frame to generate a second feature.

12. The display device of claim 11, wherein the frame memory is configured to store the first feature and the second feature in the frame unit.

13. The display device of claim 11, wherein the variation calculator comprises:

a first calculator configured to calculate a total grayscale value variation that is a variation between the first feature of the previous frame and the first feature of the current frame; and a second calculator configured to calculate an edge variation that is a variation between the second feature of the previous frame and the second feature of the current frame.

14. The display device of claim 13, wherein the pulse determiner is configured to:

in response to the total grayscale value variation and the edge variation being 0, determine the number of scan pulses as 1; and in response to the total grayscale value variation being larger than 0, adjust the number of scan pulses according to variation ranges divided by the threshold values.

15. A display device comprising:

a display panel comprising a plurality of pixels each coupled to a scan line and a data line;

a scan driver configured to supply a scan signal having at least one scan pulse to the scan line; and a pulse controller configured to adjust a number of the scan pulses supplied during one frame, based on an image variation between a previous frame and a current frame, wherein the pulse controller comprises:

a frame memory configured to store image data in a frame unit;

an image variation calculator configured to calculate a grayscale value variation between the image data of the previous frame and the image data of the current frame; and a pulse determiner configured to determine the number of scan pulses supplied in the current frame by comparing the grayscale value variation with preset threshold values, and wherein the pulse determiner is configured to:

in response to the grayscale value variation being 0, determine the number of scan pulses as 1; and in response to the grayscale value variation being larger than 0, adjust the number of scan pulses according to variation ranges divided by the threshold values.

16. A method for driving a display device, the method comprising:

calculating an image variation from image data of a previous frame and image data of a current frame;

determining a number of scan pulses of a scan signal supplied to one scan line during one frame, based on the image variation; and displaying an image by supplying the scan signal and a data signal to a pixel, wherein the determining of the number of scan pulses comprises: increasing the number of scan pulses in the one frame in response to the image variation being increased.

17. The method of claim 16, wherein, the determining of the number of scan pulses comprises: determining the number of scan pulses in the one frame to be 1 in response to the image variation being 0.

18. The method of claim 16, wherein the determining of the number of scan pulses further comprises:

determining a grayscale compensation value, based on a grayscale of the previous frame, a grayscale of the current frame, and the number of scan pulses of the scan signal; and generating the data signal by applying the grayscale compensation value to the image data of the current frame.

* * * * *